United States Patent [19]

Dunaevsky et al.

[11] 4,307,851

[45] Dec. 29, 1981

[54] APPARATUS FOR WINDING A PLURALITY OF SEPARATE STRIPS WHILE MAINTAINING TENSION IN EACH STRIP

[76] Inventors: Vladimir I. Dunaevsky, ulitsa Oktyabrskoi revoljutsii, 27, kv. 9, Slavyansk Donetskoi oblasti; Nikolai A. Sorokin, ulitsa Sverdlova, 18, Belaya Kalitva Rostovskoi oblasti; Viktor M. Levit, pereulok Silikatny, 10, Slavyansk Donetskoi oblasti; Boris M. Zapara, ulitsa Vrachebnaya, 23, kv. 59, Kramatorsk; Boris N. Ivanov, ulitsa Profinterna, 42, Slavyansk Donetskoi oblasti; Sergei A. Frolov, pereulok Generala Batjuka, 3, kv. 59, Slavyansk Donetskoi oblasti; Vladimir V. Lizenko, pereulok Parkovy, 10, kv. 7, Slavyansk Donetskoi oblasti, all of U.S.S.R.

[21] Appl. No.: 103,094

[22] Filed: Dec. 12, 1979

[51] Int. Cl.[3] ..... B65H 75/24

[52] U.S. Cl. ..... 242/56.9; 242/72 R; 242/72.1

[58] Field of Search ..... 242/56.9, 56.2, 72.1, 242/72 R; 269/48.1; 279/2 R

[56] References Cited

U.S. PATENT DOCUMENTS

| | | | |
|---|---|---|---|
| 3,010,671 | 11/1961 | Brown | 242/56.9 |
| 3,322,361 | 5/1967 | Young | 242/56.9 |
| 3,406,924 | 10/1968 | Bruns et al. | 242/56.9 X |
| 4,140,287 | 2/1979 | Hutzenlaub | 242/56.9 |
| 4,142,690 | 3/1979 | Karle et al. | 242/72.1 X |

FOREIGN PATENT DOCUMENTS

| | | | |
|---|---|---|---|
| 1079188 | 8/1967 | United Kingdom | 242/56.9 |
| 353771 | 10/1972 | U.S.S.R. . | |

*Primary Examiner*—John M. Jillions
*Attorney, Agent, or Firm*—Fleit & Jacobson

[57] ABSTRACT

A winder preferably for winding separate metal strips into coils following slitting a wider strip, comprises a power-operated mandrel and pyramidal sleeves successively mounted on this same mandrel for axial movement. On the pyramidal sleeves, mounted for longitudinal movement thereon are segmental members forming a drum section on each pyramidal sleeve for winding a separate strip. The drum sections are interconnected by split rings having a generally U-shaped cross section and mounted on the power-operated mandrel and between adjacent drum sections are drive rings frictionally engaging the end surfaces of the pyramidal sleeves, whereby axial movement of pyramidal sleeves actuated by a mechanism for imparting such movement thereto brings about setting of the apparatus from a retracted to expanded position and vice versa.

8 Claims, 13 Drawing Figures

APPARATUS FOR WINDING A PLURALITY OF SEPARATE STRIPS WHILE MAINTAINING TENSION IN EACH STRIP

BACKGROUND OF THE INVENTION

1. Field of the Invention

The present invention relates to apparatus for winding elongated flexible materials and more particularly to apparatus for winding a plurality of separate strips while maintaining tension in each strip. The invention may be utilized for rewinding rolled sheet after slitting to form a plurality of separate strips as well as for winding wire stock, fabric, wire ropes, etc. The present invention is preferably intended for winding a plurality of strips into coils while maintaining tension in each strip as used with cold-rolling mills.

A long-standing problem with the production of flat stock has been that of forming coils with uniform tightness and free from misalignment. The bowing inherent in the forming rolls is known to produce variation in thickness across the width of metal stripps, which variation tells on the rewinding of strips into coils, that is the material is wound with varying tension across the width of the strip and bulging of the strip relative the diameter of the winding cores develops.

When the single core-wound strip is run through a slitting operation to form a plurality of separate strips, the stresses within the strip are relieved, and in addition, the strips formed from the center portion of the single strip will have a slightly greater thickness than those strips formed from the edge portions. Thus when each of these separate strips are rewound on a common drum into separate coils, the tension in the strips forming the center coils of the drum is substantially greater than the tension in the strips forming the outer coils.

It is therefore desirable to maintain sufficient tension in each of the strips forming the separate coils during the rewinding operation so that the coils are not loosely formed and will not collapse after they are removed from the rewinding drum.

2. Description of the Prior Art

Solutions thus far proposed to overcome the foregoing problem are disclosed in U.S. Pat. Nos. 3,010,671; 3,322,361; and 3,406,924.

U.S. Pat. No. 3,010,671 teaches an apparatus for winding a plurality of strips while maintaining tension in the strips, which apparatus comprises a power-driven mandrel and drive rings and driven friction sleeves mounted on the mandrel and constituting friction pairs. The friction sleeves are provided with expansion chambers communicating with compressed air lines for positively holding the driving cores as the friction sleeves are rotated. To compress friction pairs, there is provided an air pressure arrangement. The arrangement is complicated in construction due to numerous packings and lines for supplying compressed air. Also, it is a rather complicated procedure to adjust the winding drum for a different number and width of the strips to be wound as well as to remove the coils and to prepare the apparatus for operation. It is to be also noted that the prior art apparatus is intended for and capable of winding the strips onto the cores only.

In an attempt to solve the foregoing problem there has been proposed an apparatus as disclosed in U.S. Pat. No. 3,322,361, said apparatus comprising a power-driven mandrel, friction drive disks mounted on the mandrel, and driven winding sections forming a winding drum and including cylindrical outer members supported through antifriction bearings on tubular inner members mounted freely on the mandrel. In order to readily remove the winding cores with coils thereon, the outer and inner members are built-up along their length, that is each member consists of two parts and is assembled on a single bearing. One part of the inner member is mounted freely on the mandrel, while the other is connected to a friction drive disk and is adapted to transmit axial load with the end of compressing the friction pairs. In this arrangement the procedure of preparing for operation and removal of the cores with coils is complicated insofar as a complete disassembly of the winding drum is required. This operation is carried out by hand. Since the parts of the inner and outer members are separately mounted on a single bearing, misalignment of the winding cores is quite possible which impairs accuracy in winding.

An apparatus disclosed in U.S. Pat. No. 3,406,924 also comprises a power-driven mandrel carrying drive rings and winding cores mounted for free rotation on the mandrel and adapted to frictionally engage the drive rings with their end surfaces, each of the drive rings being arranged between each adjacent pair of cores. This arrangement is also adapted to be assembled and disassembled in each coil-forming cycle. Moreover, the present apparatus is designed for winding strips onto cores only, which cores are too involved to produce, namely heavy demands are placed on the cores as regards the material, accuracy and roughness of the inner and end surfaces. Besides, a great number of cores are in circulation since coils are supplied on cores.

Also known in the art is an apparatus for winding a plurality of separate strips while maintaining tension in each strip as disclosed in USSR Inventor's Certificate No. 353,771, which apparatus comprises a power-driven mandrel having pyramidal portions with segmental members mounted on these pyramidal portions for axial movement thereon and a means for imparting such movement to these segmental members.

In this arrangement the mandrel and its pyramidal portions are made solid, therefore the segmental members forming a winding drum are rotated on the mandrel with the same speed and do not maintain equal tension in the strips, which cannot be tolerated for reasons given above.

This apparatus provides for winding strips directly onto the drum, that is without cores, since the means for axially moving the segmental members on pyramidal portions of the mandrel sets the winding drum from an expanded position (winding) to a retracted position (non-winding) due to which the operation of mounting cores is naturally eliminated.

Yet the prior art apparatus cannot be used for winding a plurality of separate strips after slitting the single wider strip because it does not provide constant tension in each strip and hence quality in coils.

SUMMARY OF THE INVENTION

It is an object of the present invention to provide apparatus for winding a plurality of separate strips while maintaining tension in each strip, wherein constant tension in each strip is ensured.

It is a further object of the invention to provide apparatus for winding a plurality of separate strips while maintaining tension in each strip which provides for a more accurate maintaining of tension in the strips.

It is another object of the invention to provide apparatus for winding a plurality of separate strips while maintaining tension in each strip which provides for elimination of adjustment in the winding drum when the size of the strips to be wound changes.

A further object of the invention is to provide apparatus for winding a plurality of separate strips while maintaining tension in each strip which provides for a reduced servicing time.

Still another object of the invention is to provide apparatus for winding a plurality of separate strips while maintaining tension in each strip, which apparatus having a more extended service life.

One of the objects of the invention is to provide apparatus for winding a plruality of separate strips while maintaining tension in each strip which is not substantially subjected to friction effect heretofore reducing accuracy in maintaining tension in strips.

It is yet a further object of the invention to provide an unaffected by friction apparatus for winding a plurality of separate strips while maintaining tension in each strip, exhibiting a higher operational capacity.

These and other objects of the invention which will become apparent from the following description are attained by providing apparatus for winding a plurality of separate strips while maintaining tension in each strip, comprising a power-driven mandrel having pyramidal portions for imparting such movement to these segmental members, wherein the pyramidal portions are sleeves freely and successively mounted on the mandrel and connected with their end surfaces to the mandrel through drive rings adapted to transmit torque and each sleeve has a split ring of generally U-shaped crosssection connected on one and the same side with its flange thereto, while its other flange is movably received within a circumferential slot formed in the segmental members mounted on the adjacent sleeve.

Such arrangement provides for winding each strip directly onto the winding drum, that is without using cores. When performing the winding operation, a desired winding quality is achieved due to uniform tension in each strip which is in its turn the result of such frictional connection of the winding drum with the power-driven mandrel. This arrangement provides for more accurate maintaining of tension in the strips because of constant friction pairs. The apparatus of the invention is useful in simultaneously winding strips onto several segmental members along the length of the winding drum thus eliminating the need for the reassembly of this drum and reducing servicing time. Moreover, this arrangement eliminates the necessity for some operations, mostly manual, such as mounting of the cores and the drive rings following the completion of each winding cycle.

The present invention makes it possible to better utilize the apparatus for winding strips into coils during its life time, that is without disassembly of the same and repairs until the friction linings wear out, by arranging segmental members on one sleeve and segmental members and the split ring on the adjacent sleeve so as to provide a spacing between the end surfaces of the segmental members on one said sleeve and the opposite end surfaces of the segmental members and of the split ring on said adjacent sleeve.

It is preferred that between the drive ring and the sleeve on the side where the segmental members are connected with the split ring a disk be mounted freely on the mandrel, this disk having a friction surface on the side facing the drive ring, while on the reverse side it has radially extending splines received within the corresponding radially extending slots in the segmental members to provide for radial movement of these segmental members. This intermediate disk offers a substantially discontinuous surface which makes the friction pair more effective.

With the end of gaining a more accurate adjustment of tension in strips, it is appropriate to mount each sleeve on the mandrel through a bearing assembly incorporating rolling bodies for movable support of the sleeves. This reduces friction between the mandrel and the sleeve developing under the action of the weight of the apparatus components and the coil. Due to such reduction in frictional forces, the latter are substantially less effective on tension in strips and contributing to higher quality of coils formed.

For best results the bearing assembly preferably comprises two antifriction bearings fitted with their outer surfaces in the sleeve and with their inner surfaces carried by a bush mounted on the mandrel for axial movement thereon and keyed to the same.

BRIEF DESCRIPTION OF THE DRAWINGS

A fuller understanding of the present invention will be had from the following detailed description of the embodiments thereof, taken in conjunction with the accompanying drawings, in which corresponding parts are identified by corresponding reference characters and in which.

DESCRIPTION OF THE PREFERRED EMBODIMENTS

Figure 1:
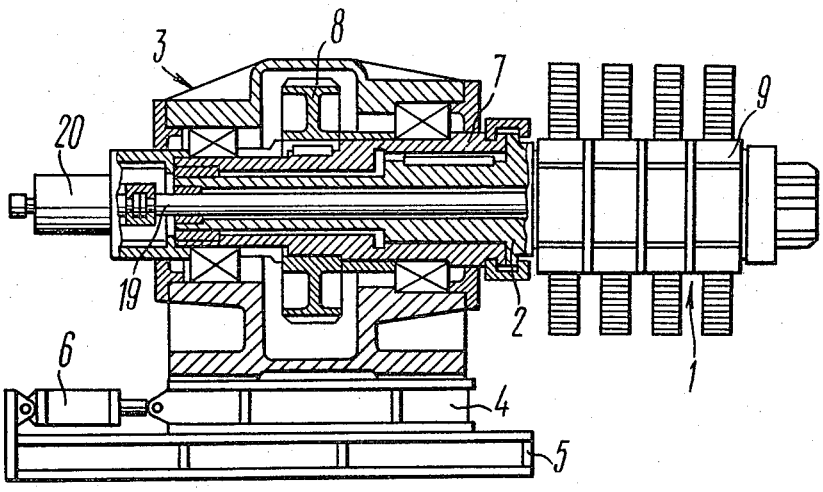
FIG. 1 is a general view of the apparatus of the invention assembled with a suitable reduction gear.

Referring to FIG. 1, an apparatus for winding a plurality of strips while maintaining tension in each strip comprises a winding drum 1 assembled on a mandrel 2 powered with a drive mechanism comprising a reduction gear 3. The reduction gear 3 is mounted on a movable frame 4 which is settable in motion on a base structure 5 by a hydraulic cylinder 6. The power-driven mandrel 2 is mounted within a tubular support casing 7 which is in turn rotatably supported in a housing of the reduction gear 3, the rotation being transmitted through a gear wheel 8 mounted on the tubular support casing 7. The winding drum 1 is composed of several drum sections 9 the number of which is selected to correspond to the number of strips to be wound.

Figure 2:
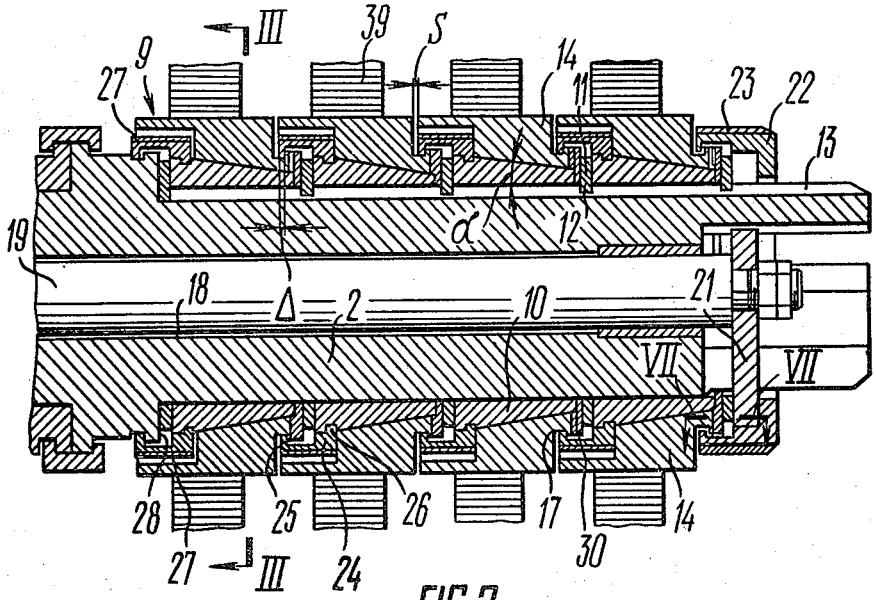
FIG. 2 is a view on an axial section of the winding drum in an expanded position.
Figure 6:
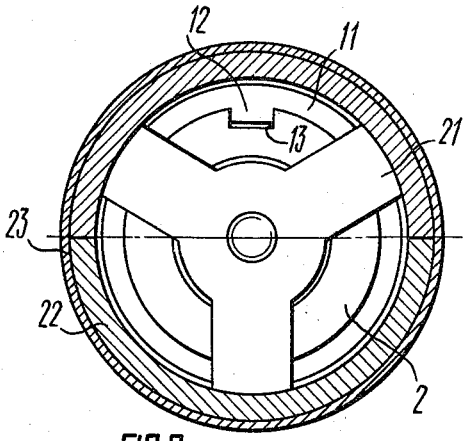
FIG. 6 is a view of the winding drum in section along the line VI—VI of FIG. 4.

Now referring to FIG. 2, the apparatus for winding a plurality of strips while maintaining tension in each strip comprises the power-driven mandrel 2 and a plurality of tapering or pyramidal sleeves 10 mounted freely on the mandrel 2. Each pyramidal sleeve 10 is a truncated pyramid having a base surface and a surface resulting from cutting off the apex portion, or a truncated pyramid having respective reverse radially extending end surfaces. In FIG. 2, the pyramidal sleeves 10 are successively mounted on the power-driven mandrel 2 so that unlike end surfaces are in opposed relationship or alternate. Between each adjacent pair of the pyramidal sleeves 10 and mounted on the mandrel 2 is a drive ring 11. This ring has drive surfaces intended to frictionally engage the corresponding end surfaces of the pyramidal sleeves 10. FIG. 2 shows the apparatus of the invention with the winding drum 1 in an expanded position, that is in a winding position when the drive rings 11 are engaged with the end surfaces of the pyramidal sleeves 10. For positive rotation with the power-driven mandrel 2, that is to function as a drive ring, and for axial movement on this same mandrel the drive ring 11 has a tang 12 received within an axially extending slot 13 in the mandrel 2 and best shown in FIG. 6.

Figure 3:
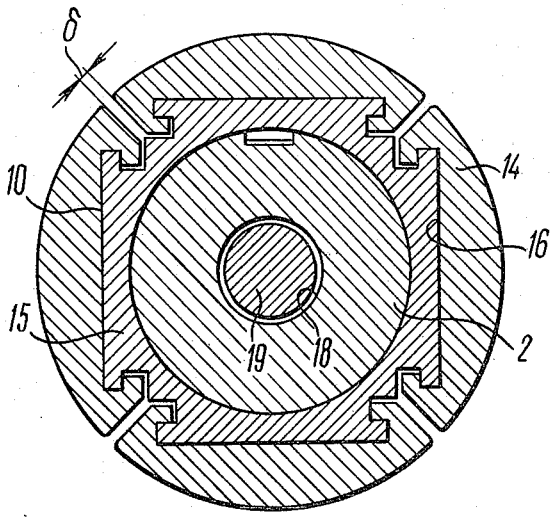
FIG. 3 is a view of the winding drum in section along the line III—III of FIG. 2.

A plurality of segmental members 14 are mounted for longitudinal movement on their own sleeve 10 and forming a drum section adapted to receive the corresponding strip as the coil is formed. As shown in FIG. 3 each pyramidal sleeve 10 has longitudinally extending T-ways 15, the latter being faces of a pyramid or guideways for the segmental members 14 for the purposes of the present invention. The segmental members 14 have inner surfaces or T-slots 16 and due to the latter are slidably fitted on the pyramidal sleeve 10 thereby enabling each segmental member 14 to be longitudinally moved on the side of the pyramidal sleeve and be retained on the latter. This arrangement is useful in setting the winding drum 1 into a winding and non-winding positions when the drum 1 is expanded and retracted respectively. This is due to the fact that each segmental member 14 is moved along the T-way 15 and apart from the axis of the power-driven mandrel 2 carrying the pyramidal sleeves 10. When the segmental members 14 are moved in a reverse direction they are approaching the axis of the power-driven mandrel 2.

It is to be understood by those skilled in the art that the winding drum 1 can be expanded and retracted if there is a clearance $\delta$ of ample size provided between segmental members 14 and shown in FIG. 3, while the angle $\alpha$ (FIG. 2) of each face on the pyramidal sleeve 10 and a respective inner surface of the segmental member 14 should be less than the angle of friction in order to avoid subsidence of the segmental members 14 as the strip is wound.

In the accompanying drawings, each segmental member 14 has an outer surface of such a curvature that when assembled on the pyramidal sleeve 10, the segmental members (this embodiment features four such members) form a cylindrical surface or the drum section 9. Each segmental member 14 has a laterally extending slot 17 formed in the outer surface thereof. These slots produce a circumferentially extending slot in each drum section 9 when the segmental members 14 are assembled on the pyramidal sleeve 10 and the slots 17 align.

To set the winding drum 1 into a winding or non-winding position, the apparatus of the invention is provided with a means for axially moving the segmental members 14.

Referring to FIGS. 1 through 3, the power-driven mandrel 2 is provided with an axially extending opening 18 through which extends a rod 19. The rod 19 is connected with one end thereof to a fluid pressure actuator 20 mounted on the tubular support casing 7 in the reduction gear 3 and with the other end the rod 19 is connected with the segmental members 14 of the outer or end section 9 carried on the mandrel 2. This is accomplished by means of an Y-shaped support member 21 and a split sleeve 22 held in position by a band 23 and received within the circumferentially extending slot of an end section 9.

The winding drum 1 is set into winding or non-winding positions by reciprocating the rod 19 within the axially extending opening 18 in the power-driven mandrel 2 by operation of fluid pressure actuator 22. Thus, the reciprocating of the rod 19 moves the pyramidal sleeves 10 and the segmental members 14 relatively to each other and along the axis of the mandrel 2.

Axial movement of the pyramidal sleeves 10 and of the segmental members 14 is made possible by split rings 24 of generally U-shaped cross-section. A ring 24 is arranged between each adjacent pair of the drum sections 9 and has a trailing flange 25 movably received within the circumferentially extending slot of one drum section 9 in a pair and a leading flange 26 connected to the pyramidal sleeve 10 carrying the other drum section 9. The trailing flange 25 is free to effect movement both circumferentially around the drum section 9 and axially because the circumferentially extending slot produced by the laterally extending slots 17 is wider than the thickness of the flange 25 by an extent providing a predetermined clearance between a side surface of this flange and that of the slot. The leading flange 26 can be connected to the pyramidal sleeve 10 by any suitable method, namely, it can be rigidly connected to the sleeve 10 as by compressing the same in a circumferentially extending slot in the sleeve 10 and also slidably fitted within a circumferential slot in the sleeve 10. The trailing and the leading flanges may be reversed with respect to that described above. For convenience in placing in position and removal, the ring 24 is held by a band 27.

Figure 4:
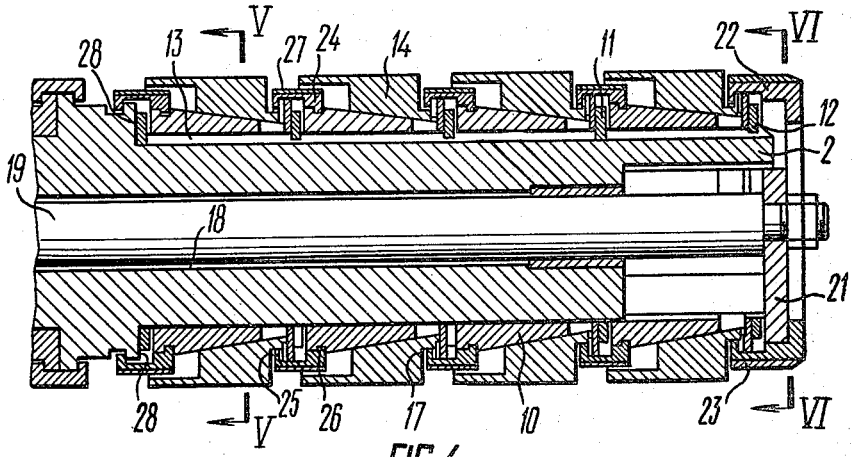
FIG. 4 is a view on an axial section of the winding drum in a retracted position.
Figure 5:
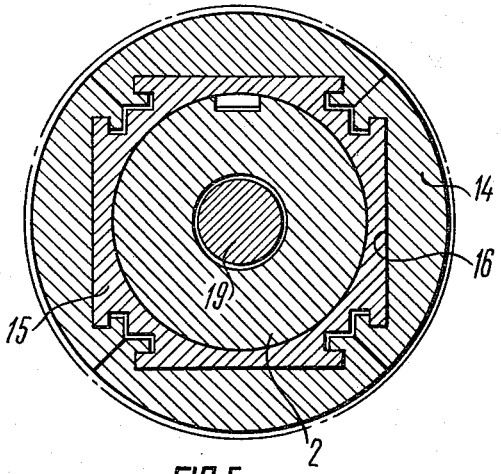
FIG. 5 is a view of the winding drum in section along the line V—V of FIG. 4.

As can be seen in FIGS. 2 and 4 the pyramidal sleeve 10, which is nearest to the reduction gear 3, is connected to the mandrel 2 through the drive ring 11 which is frictionally engageable with a shoulder 28 as well as through the ring 24.

In this way a series of the drum sections 9 is set up, which sections being interconnected so that axial movement of one outer section by the action of the fluid pressure actuator 20 will bring about a consecutive movement of all the drum sections 9 and hence setting the apparatus from a retracted to expanded position and vice versa.

In operation that is in an expanded position of the drum, between the split rings 24 and the segmental members 14 there may be established frictional contact wherein frictional forces increase as the drive rings 11 wear off. Since the drum sections 9 do not rotate with a practically constant speed during the winding cycle, friction between the split rings 24 and the segmental members 14 will disturb tension in the strips.

To overcome the trouble, disassemblying of the winding drum and change of wear linings of friction surfaces is often resorted to. Better utilization of the service life of the apparatus of the invention is attained by providing a clearance S (FIG. 2) between the end surface of the drum section 9 composed by the segmental members 14 mounted on the one pyramidal sleeve 10 and the opposite end surfaces of the drum section 9 and the split ring 24 mounted on the adjacent sleeve 10. In providing the clearance S it is imperative that wear in friction pairs be taken into account, preferably not less than the maximum wear of friction surfaces of the drive ring 11. Also, between the inner surface of the trailing flange 25 of the split ring 24 and the opposite side in the circumferentially extending slot 17 there is provided a clearance Δ which makes it possible to obviate friction between these surfaces that appearing to be of importance in maintaining constant tension in each strip irrespective of the speed of rotation of each drum section 9.

Figure 7:
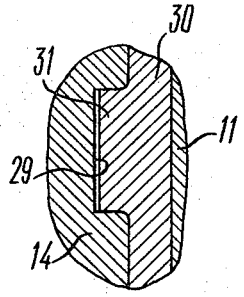
FIG. 7 is a detailed view of a portion of the apparatus of the invention in section along the line VII—VII of FIG. 2.

As shown in greater detail in FIG. 7 each segmental member 14 has a radially extending slot 29 formed in the end surface adjacent the trailing flange 25 of the split ring 24. There is a disk 30 mounted freely on the mandrel 2 and between the drive ring 11 and the end surface of the segmental members 14, adjacent the trailing flange 25. The disk 30 has a friction surface on its side facing the drive ring 11 and on the reverse side it is provided with radially extending splines 31 received within the corresponding radially extending slots 29 of the segmental members 14. The radially extending splines 31 are slidably received within the radially extending slots 29 thus providing torque transmission from the drive rings 11 to the segmental members 14 and unobstructed radial movement of the segmental members 14 as each drum section 9 retracts and expands.

Figure 11:
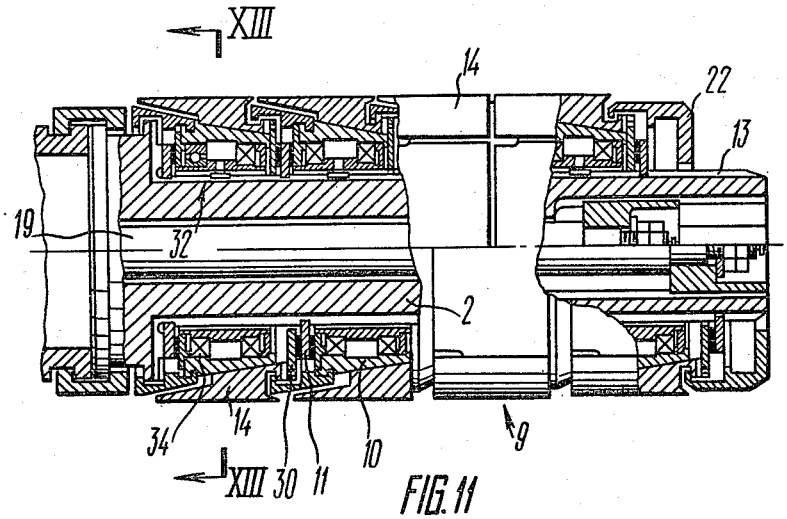
FIG. 11 is a view of the winding drum constructed according to an alternative embodiment and in axial section, the drum portion shown above the center line being in an expanded position, while that shown under the center line being in a retracted position.
Figure 13:
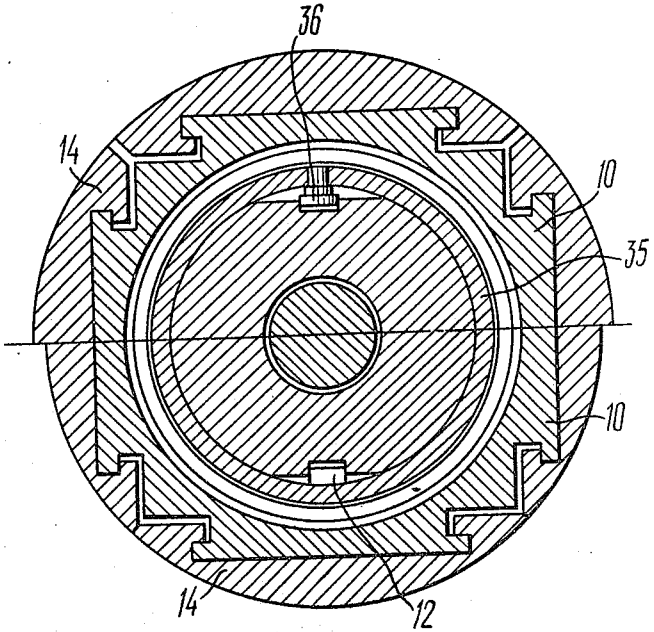
FIG. 13 is a view of the winding drum in section taken along the line XIII—XIII of FIG. 11.
Figure 12:
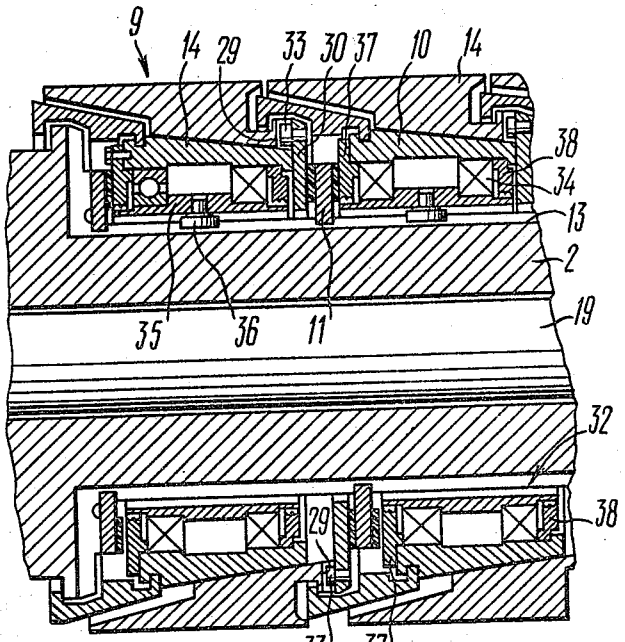
FIG. 12 is a drum detail view of that shown in FIG. 11.

Shown in FIG. 11 and in greater detail in FIG. 12 is an alternative embodiment wherein each drum section 9 is mounted on the power-driven mandrel 2 through an antifriction bearing assembly 32 which is employed as a support for each pyramidal sleeve 10.

This embodiment of the apparatus includes the power-driven mandrel 2 with the drive rings 11 mounted thereon, which rings are provided with tangs received within the axially extending slot 18 of the power-driven mandrel 2 as well as the driven drum sections 9 supported on the antifriction assembly 32 comprising outer means or pyramidal sleeves 10 in the form of a truncated pyramid the faces of which accomodate the segmental members 14, and the driven disks 30 associated with the segmental members 14 by keys 33 received within the slots 29 are also forming part of this embodiment. The pyramidal sleeves 10 are supported through antifriction bearings 34 on bushes 35 keyed to the power-driven mandrel 2 by keys 36. The interior of each bearing assembly 32 is closed by side plates 37 and 38, of which that designated by the reference numeral 37 is operatively connected to the drive disk 11. This embodiment serves to illustrate how higher accuracy and improvement in coil quality can be achieved by supporting the drum sections on continuous bushes, wherein the antifriction bearings are adequately spaced as well as making friction losses controllable thus providing for better control of tension in all the strips.

The apparatus of the invention makes it possible to wind the strip either onto the drum sections or cores.

Now follows a description of operation of the apparatus according to the invention as used in the production line for slitting a single wider strip into a plurality of strips of a predetermined width and rewinding the strips into separate coils though this production line is not described in detail and not shown in the drawings since it is not forming part of the invention.

Prior to initiation of the winding operation the fluid pressure actuator 20 is energized to pull the rod 19 inwardly causing all the components of the winding drum to take the position as shown in FIG. 2.

After the leading ends of the separate strips are attached to the outer surfaces of the corresponding drum sections 9, preferably by a suitable tape, and the strips are given $1\frac{1}{2}$ wraps around the section 9, the winding operation is started by energizing the electric motor (not shown) to drive the mandrel 2, which starts the forming of the coils 39. During this winding operation, tension is maintained in the rod 19 by the fluid pressure actuator 20 so that the end surfaces of the pyramidal sleeves 10 are compressed firmly against the drive surfaces of the drive rings 11. This provides an end friction drive of each of the drum sections 9 causing the latter to rotate with the power-driven mandrel 2. As the coils 39 are formed on the corresponding drum sections 9 the outer diameter of the center coils will normally increase at a faster rate than the end coils, due to the variations in thickness across the width of the single wider strip. It has been found desirable to rotate the mandrel 2 at a slightly higher speed than is necessary to wind the outside strips on the corresponding drum sections 9 so that all of the drum sections slip somewhat in relation to the mandrel 2.

This has been found to maintain a continuous tension in all of the separate strips, but it becomes apparent that the inner drum sections 9 will slip in relation to the outer cylindrical surface of the power-driven mandrel 2 more than the outer sections 9.

As the winding coils 39 increase in diameter, it has been found desirable to increase the frictional drive forces between each of the drive rings 11, driven disk 30 and the respective end surfaces of the pyramidal sleeves 10. This increase is provided substantially proportionally to the increase in diameter of the coils 39 by increasing the pressure within the cylinder of the fluid pressure actuator 20 making use of the means known to those skilled in the art.

For this pressure control, any device as, for example, that described in U.S. Pat. No. 3,406,924 and incorporated into this specification by reference, may be used.

Figure 9:
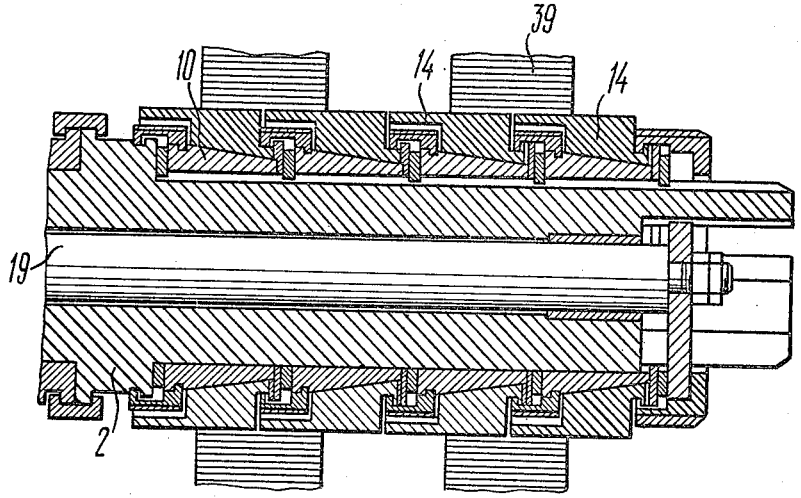
FIG. 9 is a view of the winding drum in axial section as used in simultaneous winding of each strip on two drum sections.
Figure 10:
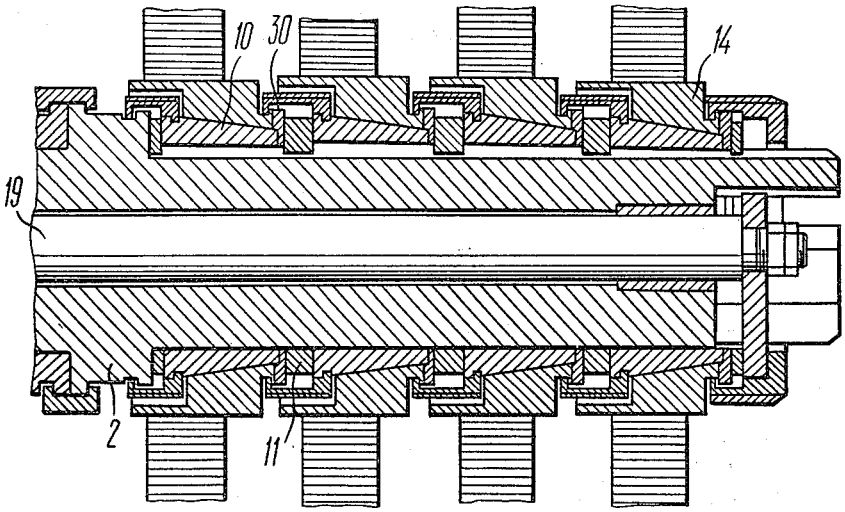
FIG. 10 is a view of the winding drum, illustrative of the instance when the gap between strips changes.

After the winding operation is completed, the fluid pressure actuator 20 is operated causing the rod 19, the Y-shaped support member as well as the split rings 24 and the split sleeve 22 to move outwardly and thus consecutively setting the drum sections 9 into a retracted position. In performing this, the segmental members 14 will move axially as long as the clearance δ is taken up. Following this, the drum section 9 will move axially as an integral part causing the other drum sections 9 to retract. The separate coils are then removed from the winding drum 1. In order to wind strips of a different width, the apparatus of the invention may be adjusted by shifting the whole of the drum 1 with the help of the hydraulic cylinder 6, or by changing the distance between the drum sections 9 with the help of interchangeable split rings 24 and drive rings 11 (FIG. 10), or the strips may be wound each onto several drum sections 9 (FIG. 9).

Figure 8:
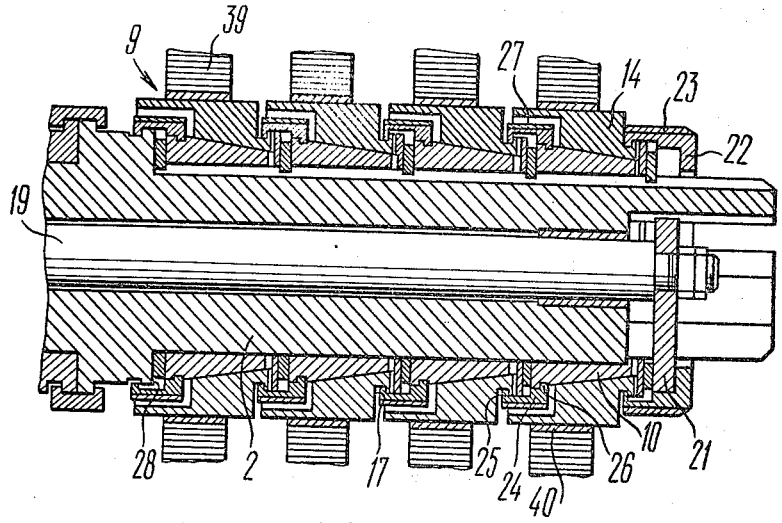
FIG. 8 is a view of the winding drum in axial section as used in winding strips on cores.

If the strips are wound onto cores 40 (FIG. 8), the apparatus of the invention operates as above but in this case the inner diameter of the cores 40 is selected to be undersize of that of the drum sections 9 when they are in expanded position between the drive ring 11 and the pyramidal sleeve 10 of each adjacent drum section 9 (when the driven disk 30 is used between this disk and the pyramidal sleeve 10) a clearance develops since the inner diameter of the cores 40 is selected to be undersize of that of the drum sections 9 when they are in expanded position. When used with the apparatus of this invention, the cores are not under stringent requirements as to the accuracy of the inner diameter, parallelism and roughness of the end surfaces as well as to the material used.

The apparatus of this invention, when used in the lines for slitting a wider strip, makes it possible to increase production due to cuts in set-up time as well as to reduce cost of core production or completely eliminate the use of cores.

While the invention has beeen described herein in terms of the preferred embodiments, numerous variations may be made in the apparatus illustrated in the drawings and herein described without departing from the invention as set forth in the appended claims.

What is claimed is:

1. Apparatus for winding a plurality of separate strips while maintaining tension in each strip, comprising:

(a) a power-driven mandrel, (b) a plurality of pyramidal sleeves each having opposite radially extending base and top end surfaces and mounted for free rotation on said mandrel with the base of one sleeve adjacent the top of the next sleeve, (c) a drive ring mounted on said mandrel between each adjacent pair of said sleeves for axial movement on said mandrel and for positive rotation with the same, said drive ring having drive surfaces frictionally engaging the corresponding end surfaces of said sleeves;

(d) a plurality of segmental members mounted for longitudinal movement on each said sleeve and forming a drum section adapted to receive a strip as the coil is formed, each said segmental member having a laterally extending slot formed in the outer surface thereof forming a circumferentially extending slot in each said drum section, (e) means for axially moving said segmental members to frictionally associate the same with said drive rings as the coils are formed, (f) a split ring of generally U-shaped cross section arranged between each adjacent pair of the drum sections and having a trailing flange movably received within the circumferentially extending slot of one of the drum sections of the pair and a leading flange connected to said sleeve carrying the other drum section, whereby axial movement of one drum section actuated by said means for axially moving said segmental members brings about successive movement of all the drum sections and therefore setting of the apparatus from a retracted to expanded position and vice versa.

2. Apparatus as defined in claim 1, wherein the end surface of said segmental member on one of said sleeves and the confronting end surface of said segmental member on the adjacent of said sleeves and of said split ring connected to said adjacent sleeve are arranged in spaced relationship extending radially outwardly from said mandrel.

3. Apparatus as defined in claim 2, wherein each said segmental member has a radially extending slot and said apparatus further comprises a disk mounted freely on said mandrel between said drive ring and said sleeve on the side where the drum section mounted thereon is connected with said split ring and having a friction surface on the side facing said drive ring, while on the reverse side, said disk having radially extending splines each of which is received within the corresponding radially extending slot in each said segmental members to provide torque transmission from said drive rings to said segmental members and for unobstructed radial movement of said segmental members.

4. Apparatus as defined in claim 2 comprising an antifriction bearing assembly mounted on said mandrel and supporting each said sleeve.

5. Apparatus as defined in claim 4 further comprising a bush mounted on said mandrel for axial movement thereon and wherein said bearing assembly comprises two antifriction bearings mounted on said bush and supporting said sleeve.

6. Apparatus as defined in claim 1, wherein each said segmental member has a radially extending slot and said apparatus further comprises a disk mounted freely on said mandrel between said drive ring and said sleeve on the side where the drum section mounted thereon is connected with said split ring and having a friction surface on the side facing said drive ring, while on the reverse side, said disk having radilly extending splines, each of which is received within the corresponding radially extending slot in each said segmental members to provide torque transmission from said drive rings to said segmental members and for unobstructed radial movement of said segmental members.

7. Apparatus as defined in claim 1 comprising an antifriction bearing assembly mounted on said mandrel and each supporting each said sleeve.

8. Apparatus as defined in claim 7 further comprising a bush mounted on said mandrel for axial movement thereon and wherein said bearing assembly comprises two antifriction bearings mounted on said bush and supporting said sleeve.

* * * * *